United States Patent [19]

Hamby et al.

[11] Patent Number: 4,858,802

[45] Date of Patent: Aug. 22, 1989

[54] WATER SKI STORAGE RACK FOR BOATS

[76] Inventors: Rodney L. Hamby, Rte. E, Box 707A; Ronald L. Hamby, both of Rte. E, both of, Caulfield, Mo. 65626; Grant Q. Haden, P.O. Box 698, Ava, Mo. 65608

[21] Appl. No.: 71,775

[22] Filed: Jul. 10, 1987

[51] Int. Cl.[4] ..... B60R 9/12; F16M 13/02

[52] U.S. Cl. ..... 224/273; 224/42.45 R; 224/917; 114/364; 248/160

[58] Field of Search ..... 211/70.5; 248/160, 900; 403/190; 224/273, 42.45 R, 42.43, 42.44, 326, 282, 309, 310, 314, 315, 317, 318, 319, 325, 917; 114/364

[56] References Cited

U.S. PATENT DOCUMENTS

| | | | |
|---|---|---|---|
| 2,094,475 | 9/1937 | Schwarzhaupt | 248/160 X |
| 2,698,119 | 12/1954 | Cicogna | 224/42.43 |
| 3,018,897 | 1/1962 | Carlyle | 224/42.45 R X |
| 3,291,427 | 12/1966 | Hutchings | 224/42.45 R |
| 3,527,354 | 9/1970 | Sokolow | 211/70.5 |
| 3,701,436 | 10/1972 | Adams | 211/70.5 |
| 3,776,437 | 12/1973 | Carney | 224/42.45 R |
| 3,811,143 | 5/1974 | Page | 211/70.5 X |
| 4,056,220 | 11/1977 | Trimble | 224/42.45 R |
| 4,226,351 | 10/1980 | Biermann et al. | 224/325 |
| 4,232,806 | 11/1980 | Shald | 211/70.5 X |
| 4,234,112 | 11/1980 | Gallant | 224/42.43 |
| 4,582,015 | 4/1986 | Hunter | 211/70.5 X |

FOREIGN PATENT DOCUMENTS

| | | | |
|---|---|---|---|
| 3221126 | 12/1983 | Fed. Rep. of Germany | 224/917 |
| 3539288 | 5/1987 | Fed. Rep. of Germany | 224/917 |

*Primary Examiner*—Henry J. Recla
*Assistant Examiner*—Robert M. Fetsuga
*Attorney, Agent, or Firm*—Senniger, Powers, Leavitt & Roedel

[57] ABSTRACT

A rack for storing water skis and the like on a boat outside of the cockpit, the rack comprising at least two laterally spaced generally parallel rack members, each rack member comprising two generally perpendicular arms forming a generally upwardly facing V-shaped support, and a base adapted to mount the V-shaped support on the boat outside of the cockpit. The base and the V-shaped support can be made separate and resiliently connected to allow the support to resiliently deflect relative to the base in response to applied pressure.

17 Claims, 3 Drawing Sheets

WATER SKI STORAGE RACK FOR BOATS

BACKGROUND OF THE INVENTION

This invention relates to a water ski rack for boats, and in particular to such a rack for storing water skis on the boat.

The cockpit of most boats used for waterskiing is typically small, and usually very crowded. Storing the large and cumbersome skis when not in use is a problem. If the skis are merely left on the floor of the cockpit they may cause the occupants to trip or they may slide due to the motion of the boat causing injury or damage. Some boats have a compartment for storing water skis, but these are typically small, and it is usually very difficult and time consuming to store and remove the skis from these compartments, especially without damaging the skis.

Racks have been made for storing water skis on a boat. For example, Carney, U.S. Patent No. 3,776,437, Simmonds, U.S. Patent No. 3,925,836, Trimble, U.S. Patent No. 4,056,220, and Shald, U.S. Patent No. 4,232,806, all disclose racks for water skis. For the most part, these racks are all very complex and cumbersome devices. The racks are difficult to store when not in use and interfere with full use of the boat.

SUMMARY OF THE INVENTION

Among the objects of the present invention is the provision of a rack for safely and securely storing water skis, preferably outside of the cockpit of the boat but in a readily accessible location; the provision of such a device that is of simple and inexpensive construction; the provision of such a device that is easy to install, and which can be easily removed and stored when not in use; the provision of such a device that is compact and unobtrusive and does not interfere with the appearance or use of the boat. It is also an object of at least one embodiment of the invention to provide such a rack that is yieldable in response to applied pressure to thereby reduce the chance of injury from a person falling against it.

Generally, the rack of this invention comprises at least two laterally spaced, generally parallel rack members. Each rack member comprises a post mounted on the deck of the boat, preferably exteriorly of the cockpit and raked outwardly from the cockpit of the boat, an arm, and means for mounting the arm perpendicularly to the post with the arm and the upper portion of the post forming the legs of a generally upwardly-facing "v" for receiving the skis. In one embodiment, the posts comprise a lower member and an upper member, and means for resiliently connecting the lower and upper members to allow the post to flex in response to applied pressure. The posts can be releasably mounted on the boat deck in a socket member, to permit their removal when the rack is not in use.

The posts and the arms form upwardly facing V's exteriorly of the cockpit for receiving the skis to safely and securely store the water skis outside of the cockpit of the boat. The rack is of very simple and inexpensive construction. The rack is easily installed by simply mounting brackets to the boat deck. The posts can be releaseably mounted in these sockets and can be easily removed and stored when not in use. The rack is compact and unobtrusive. In one embodiment of the invention, the post is made flexible to yield in response to applied pressure to reduce the chance of injury to a person falling against it.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
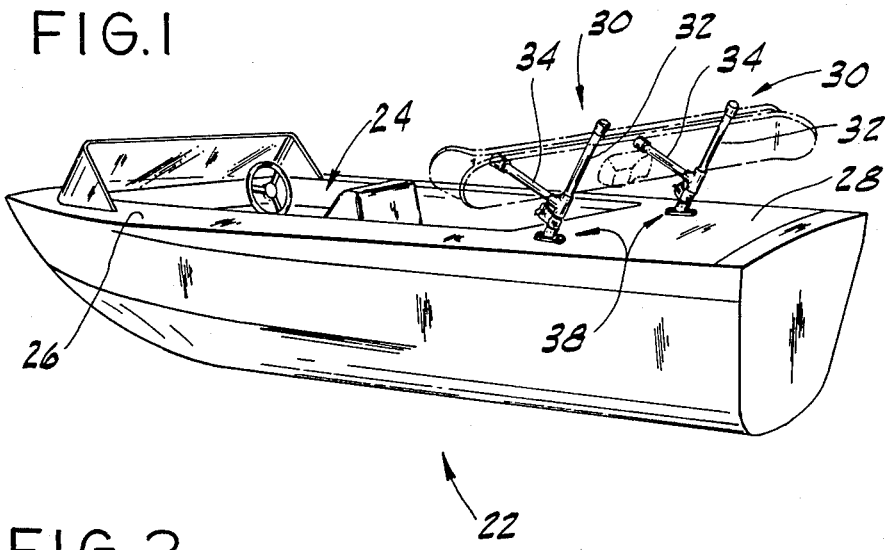
FIG. 1 is a perspective view of a ski boat provided with a rack according to the principles of the present invention.
Figure 2:
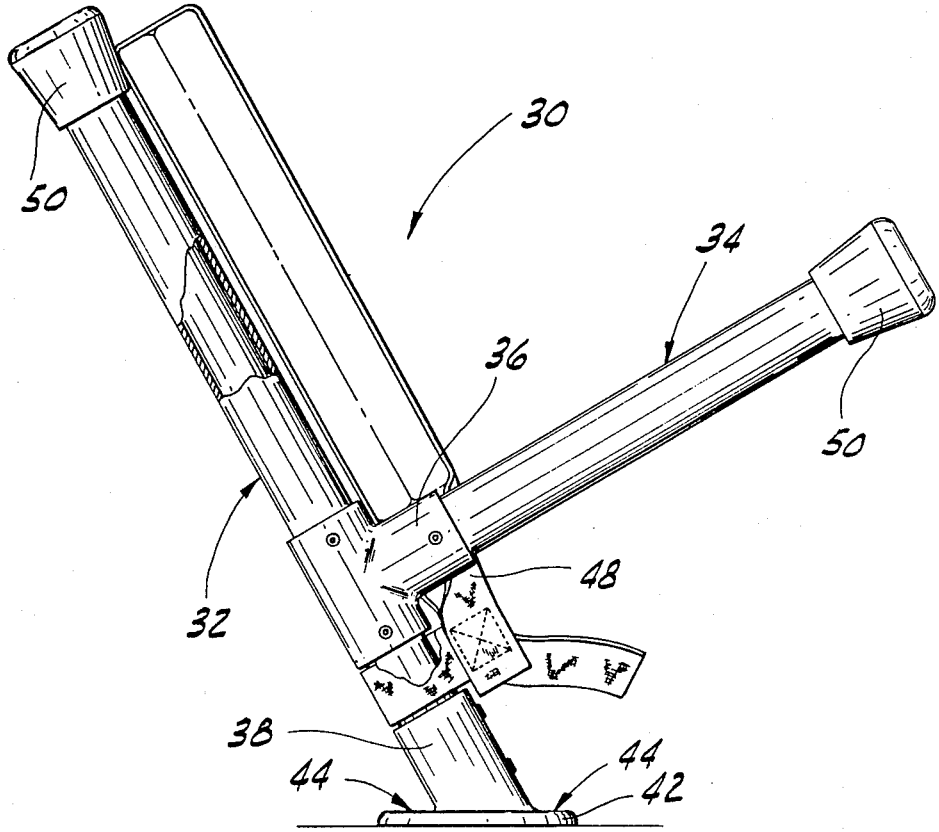
FIG. 2 is a side elevation view of one of the rack members of the rack shown in FIG. 1.

A water ski storage rack according to the principles of the present invention, indicated generally as 20, is shown in FIG. 1 as it would be mounted on a water ski boat 22. Boat 22 has a cockpit 24, surrounded by a deck 26, the portion of the deck behind the cockpit generally being called the afterdeck 28.

Rack 20 comprises at least two, and preferably two, rack members 30. The rack members are laterally spaced from each other and oriented generally parallel to each other, and are preferably positioned aft of the cockpit on the afterdeck 28. The rack members could be positioned inside the cockpit, if desired. Each rack member comprises a post 32 mounted to the deck of the boat and raked or sloped generally outwardly from the cockpit, an arm 34, and a bracket 36 for mounting the arm to the post. The post can be mounted on the deck in a socket member 38, comprising a generally cylindrical socket 40 oriented generally outwardly from the cockpit. Socket member 38 further comprises a flange 42 surrounding the socket. Holes 44 can be provided in flange 42 to secure the socket member 38 to the deck. Set screws 46 may be used to releasably secure post 32 in the socket member 38. The post is preferably releasably held in the socket, so that when the rack is not needed the posts can be removed and stored.

Bracket 36 is generally T-shaped, with the top of the T receiving a portion of the post 32 and the stem of the T receiving arm 34. Because of the rake of the post, the arm 34 and the portion of the post 32 above the arm form a generally upwardly-facing "V" for receiving the skis. The posts are preferably positioned on the deck so that the arms extend generally toward the cockpit, but are spaced sufficiently from the cockpit that the arms do not protrude into the cockpit. Thus, the "V" is positioned exteriorly of the cockpit.

Retaining straps 48 can be provided to retain skis in the rack. Straps 48 may be secured by any conventional means, for example buckles, snaps, or hook-and-loop type fastening material such as Velcro (tm). The post and the arm are preferably hollow and tubular for strength, light weight, and the elimination of sharp edges which could cause injury. The ends of the posts and arms can be provided with safety caps 50 to protect the occupants of the boat from any sharp edges.

Figure 3:
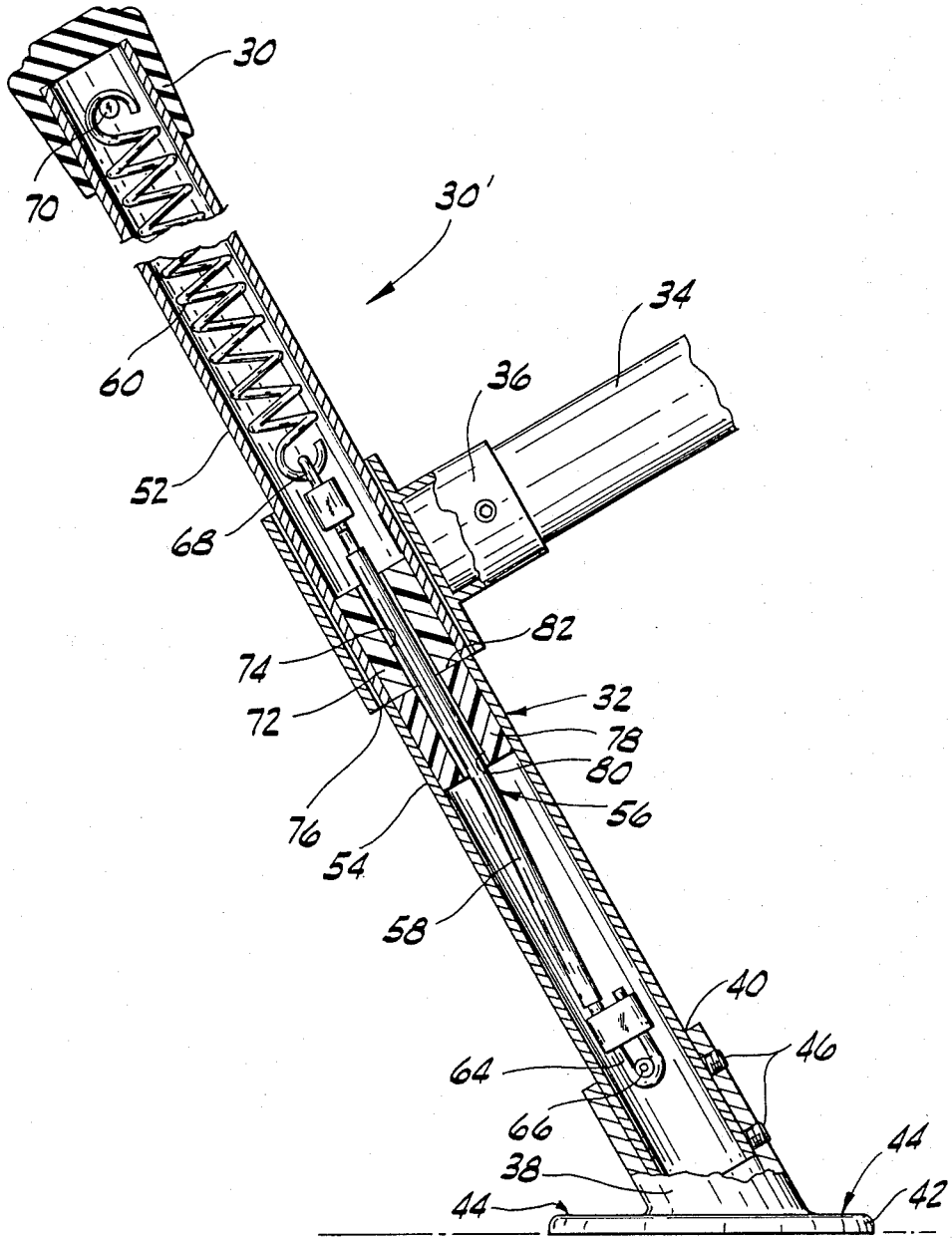
FIG. 3 is a side elevation view of a second embodiment of a rack member, wherein the post is constructed in more than one piece to deflect in response to applied pressure.
Figure 4:
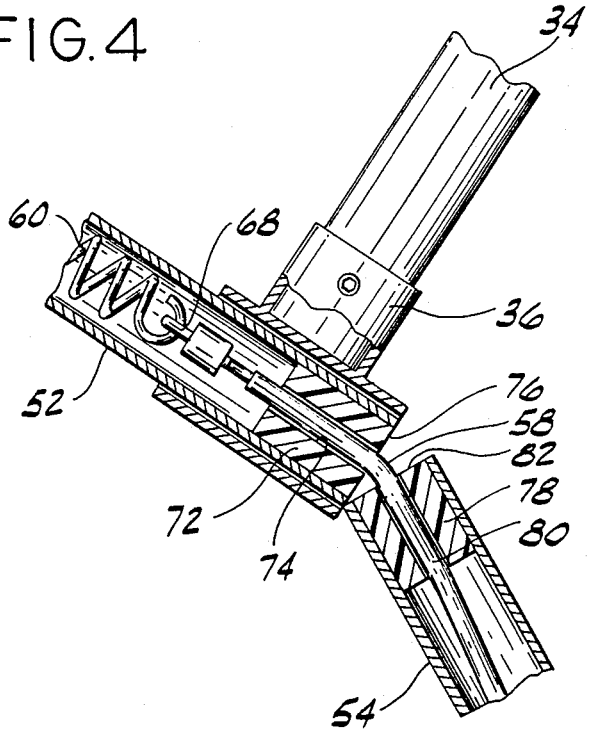
FIG. 4 is an enlarged partial side view of the second embodiment, showing the post deflected.

A second embodiment of a rack member is shown in FIGS. 3 and 4, and is indicated generally as 30'. Rack member 30' is similar to rack member 30, and corresponding parts are identified with the same reference numerals. However, rack 30' comprises post 32 which comprises upper member 52 and lower member 54, which are axially aligned, with the lower end of the upper member generally adjacent the upper end of the lower menber. The upper and lower members are connected by a resilient connecting means, indicated generally as 56.

In the preferred embodiment resilient connecting means 56 comprises a cord 58, connected at one end to the upper member 52 and connected at the other end to the lower member 54. This cord could be resilient, or could itself comprise a spring. Preferably, however, means such as spring 60 is provided to tension the cord 58. As shown in FIG. 3, the lower end of the cord 58 is attached to the lower member, as by forming a loop 64 in the cord and attaching it to the lower member with a roll pin 66 extending through the lower member. The upper end of cord 58 is attached to the lower end of spring 60, as by forming a loop 68 in the cord. The upper end of spring 60 is attached to the upper member 52 as with roll pin 70 extending through the upper member.

A plug 72 is positioned in the lower end of the upper member 52. Plug 72 has a generally axial aperture 74 therethrough for receiving the cord 58, and forms an abutment surface 76 for the lower member. A plug 78 is likewise positioned in the upper end of the lower member 54. Plug 78 has a generally axial aperture 80 therethrough aligned with aperture 74 in plug 72, for receiving the cord 58. Plug 78 forms an abutment surface 82 for the lower end of the upper member 52.

The bracket 36 is positioned generally over the lower end of the upper member. As shown in FIG. 4, the upper and lower members 52 and 54 of post 32 are therefore able to flex relative to one another in response to applied pressure, for example if someone should fall against it. The resiliency of the spring 60 draws the upper and lower members together, with the abutment surfaces formed by the plugs facilitating proper alignment of the upper and lower members.

OPERATION

At least two rack members 30 and 30' are installed to the deck of the boat 20, laterally spaced but oriented generally parallel with each other. The rack members form aligned upwardly facing "V"s which, as shown in FIG. 1, will support and carry water skis (shown in phantom). Straps 48 are used to secure the skis in the rack. When not in use the rack members can be left in place. They are simple and small enough to be unobtrusive and to not interfere with use of the boat. The racks can also be removed, leaving just the socket members on the deck of the boat. The rack holds the skis on a readily accessible position exteriorly of the cockpit.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rack for storing water skis and the like on a boat, the rack comprising at least two laterally spaced generally parallel rack members, each rack member comprising:

two generally perpendicular arms, each arm being sloped with respect to vertical and horizontal to form a generally upwardly-facing V-shaped support for receiving the skis;

a base adapted to mount the V-shaped support on the boat outside of the cockpit, the base and the V-shaped support being separate; and means for resiliently connecting the base and the support to allow the support to resiliently deflect relative to the base in response to applied pressure.

2. The rack according to claim 2 wherein the resilient connecting means comprises a cord extending between the support and the base, and means for resiliently tensioning the cord.

3. The rack according to claim 3 wherein the means for resiliently tensioning the cord comprises a spring.

4. A rack for storing water skis and the like on a boat outside the cockpit, the rack comprising at least two laterally spaced, generally parallel rack members, each rack member comprising:

a post mounted on the boat and raked outwardly from the cockpit at an angle with respect to vertical and horizontal;

an arm;

means for mounting the arm generally perpendicularly to the post, to extend generally upwardly and toward the cockpit, the arm and the upper portion of the post forming the arms of a generally upwardly-facing "V" for receiving the skis, the means for mounting the arm to the post comprising a generally T-shaped bracket, with the top of the T mounted over the post, and the stem of the T receiving the arm.

5. A rack for storing water skis and the like on a boat outside the cockpit, the rack comprising at least two laterally spaced, generally parallel rack members, each rack member comprising:

a post mounted on the boat and raked outwardly from the cockpit at an angle with respect to vertical and horizontal, the post comprising an upper member and a lower member, and means for resiliently connecting the upper and lower members to allow the post to flex in response to applied pressure;

an arm; and means for mounting the arm generally perpendicularly to the post, to extend generally upwardly and toward the cockpit, the arm and the upper portion of the post forming the arms of a generally upwardly-facing 'V" for receiving the skis.

6. The rack according to claim 5 wherein the means for resiliently connecting the upper and lower post members comprises a spring inside the post, one end of the spring being connected to the upper post member and the other end of the spring being connected to the lower post member.

7. The rack according to claim 5 wherein the means for resiliently connecting the upper and lower post members comprises a cord connected at one end to the upper post member and connected at the other end to the lower post member, and means for resiliently tensioning the cord.

8. The rack according to claim 7 wherein the means for resiliently tensioning the cord comprises a spring in one of the post members attached at one end to the post member and attached at the other end to the cord.

9. The rack according to claim 7 further comprising a centering plug in at least one of the post members, the centering plug having a central aperture for receiving and centering the cord.

10. The rack according to claim 5 wherein each rack member further comprises a socket member adapted to be mounted on the deck of the boat outside of the cockpit, with the socket oriented generally outwardly from the cockpit of the boat.

11. The rack according to claim 10 wherein the socket member comprises a generally cylindrical socket and a flange around the lower end of the socket, the flange having a plurality of mounting holes therein for attaching the socket to the boat deck.

12. The rack according to claim 11 wherein the sockets are adapted to be mounted to the deck of the boat behind the cockpit.

13. The rack according to claim 4 wherein the post comprises upper and lower post members, the upper end of the lower post member abutting the lower end of the bracket, and means for resiliently connecting the lower post member to the upper post member and bracket.

14. The rack according to claim 12 wherein the means for resiliently connecting the upper and lower post members comprises a cord connected at one end to the upper post member and connected at the other end to the lower post member, and means for resiliently tensioning the cord.

15. A rack for storing water skis and the like on a boat outside of the cockpit, the rack comprising at least two laterally spaced generally parallel rack members, each rack member comprising:

a post mounted on the boat and raked outwardly from the cockpit of the boat, the post comprising aligned upper and lower post members;

a generally T-shaped bracket on the lower end of the upper post member, with the top of the T coaxial with the post members and the stem of the T extending generally forwardly, the lower end of the bracket abutting the upper end of the lower post member;

a plug in at least one of the abutting ends of the bracket and lower post member, the plug having a generally axial aperture therein and forming an abutment surface for the other end;

a cord extending through the post members and the apeture in the plug, and connected at one end one of the posts member and connected at the other end to the other of the post members;

means for resiliently tensioning the cord to allow the upper post member and bracket to resiliently deflect relative to the lower post member;

an arm mounted in the stem of the T-shaped bracket and extending generally upwardly and toward the cockpit, the arm and the upper post member forming the arms of a generally upwardly-facing "V" for receiving the skis.

16. The rack according to claim 15 wherein the means for tensioning the cord comprises a spring inside one of the post members attached at one end to the post member and at the other end to the end of the cord, thereby connecting the cord and the post member.

17. In combination with a boat having a cockpit surrounded by a deck with an afterdeck to the rear of the cockpit, a rack for storing water skis and the like exteriorly of the cockpit, the rack comprising at least two transversely space rack members mounted on the afterdeck of the boat, each rack member comprising:

a socket member mounted on the afterdeck of the boat exteriorly of the cockpit, with the socket oriented generally outwardly from the cockpit of the boat;

a post releasably secured in the socket, and raked rearwardly and outwardly from the cockpit at an angle with respect to vertical and horizontal;

an arm;

a bracket mounting the arm generally perpendicularly to the post, with the arm extending upwardly and forwardly toward the cockpit; the arm and the upper portion of the post forming the arms of a generally upwardly-facing "V" for receiving a portion of the skis.

* * * * *